US006414606B1

(12) United States Patent
Yujiri et al.

(10) Patent No.: US 6,414,606 B1
(45) Date of Patent: Jul. 2, 2002

(54) ENHANCED PAINT FOR MICROWAVE/MILLIMETER WAVE RADIOMETRIC DETECTION APPLICATIONS AND METHOD OF ROAD MARKER DETECTION

(75) Inventors: M. Larry Yujiri, Torrance; Bruce I. Hauss, Los Angeles; Bill H. Quon, Aliso Viejo; James E. Eninger, Torrance, all of CA (US)

(73) Assignee: TRW Inc., Redondo Beach, CA (US)

( * ) Notice: Subject to any disclaimer, the term of this patent is extended or adjusted under 35 U.S.C. 154(b) by 355 days.

(21) Appl. No.: 09/637,826

(22) Filed: Aug. 11, 2000

Related U.S. Application Data

(62) Division of application No. 09/342,786, filed on Jun. 29, 1999, now Pat. No. 6,157,320, which is a continuation of application No. 08/864,249, filed on May 28, 1997, now Pat. No. 6,194,486.

(51) Int. Cl.[7] ..... G08G 1/00

(52) U.S. Cl. ..... 340/901; 340/905; 340/933; 340/941; 340/904; 180/167; 180/168; 180/169

(58) Field of Search ..... 340/901, 905, 340/933, 941, 904; 180/168, 169, 167

(56) References Cited

U.S. PATENT DOCUMENTS

| | | | | | |
|---|---|---|---|---|---|
| 3,725,930 | A | * | 4/1973 | Caruso | 343/100 |
| 3,998,645 | A | * | 12/1976 | Okazki | 106/30 |
| 4,518,722 | A | * | 5/1985 | Shutt | 523/135 |
| 4,600,642 | A | | 7/1986 | Lodge et al. | 428/367 |
| 4,621,265 | A | * | 11/1986 | Buse | 342/169 |
| 4,758,469 | A | * | 7/1988 | Lange | 428/325 |
| 4,916,014 | A | * | 4/1990 | Weber | 428/403 |
| 4,947,094 | A | * | 8/1990 | Dyer | 318/587 |
| 5,039,557 | A | * | 8/1991 | White | 427/137 |
| 5,202,742 | A | * | 4/1993 | Frank | 365/5 |
| 5,493,291 | A | * | 2/1996 | Bruggemann | 340/905 |
| 5,516,227 | A | * | 5/1996 | Kozak | 404/9 |
| 5,875,408 | A | * | 2/1999 | Bendett et al. | 701/23 |

FOREIGN PATENT DOCUMENTS

| | | |
|---|---|---|
| EP | 0135740 | 4/1985 |
| GB | 2237862 | 5/1991 |
| WO | 9621700 | 7/1996 |

* cited by examiner

*Primary Examiner*—Daniel J. Wu
*Assistant Examiner*—Tai T. Nguyen
(74) *Attorney, Agent, or Firm*—Michael S. Yatsko; Ronald M. Goldman

(57) ABSTRACT

Adding a quantity of metallic shot or particles of other materials having a high dielectric constant to the thermoplastic paint in the mixing pot of ordinary roadway marker fixation equipment, which extrudes the paint and applies same to the roadway surface, enhances the MMW radiometric visibility of the marker without adverse effect to the affixation equipment. Vehicles containing MMW radiometers directed down toward the roadway surface moves along the roadway surface is able to automatically sense microwave/millimeter wave energy from a marker in the vehicles path. In one system, the sensed energy is used in conjunction with other apparatus to assist to guide the vehicle within a traffic lane. In another system, the sensed energy is decoded and displayed as pertinent information for the vehicle's driver.

2 Claims, 4 Drawing Sheets

ENHANCED PAINT FOR MICROWAVE/MILLIMETER WAVE RADIOMETRIC DETECTION APPLICATIONS AND METHOD OF ROAD MARKER DETECTION

This is a divisional of U.S. patent application Ser. No. 09/342,786, filed on Jun. 29, 1999 (now U.S. Pat. No. 6,157,320 issued Dec. 5, 2000), which is a continuation of U.S. patent application Ser. No. 08/864,249, filed on May 28, 1997 (now U.S. Pat. No. 6,194,486 issued Feb. 27, 2001).

FIELD OF THE INVENTION

This invention relates to new roadway marking systems, and, more particularly, to an enhancement to roadway marker paints that renders the road markers more distinguishable from the adjacent and/or underlying pavement when viewed at microwave/millimeter wave radiometric frequencies. The invention also relates to a method for ascertaining the presence of roadway markers and information coded in such markers by application of passive radiometric energy sensitive inspection apparatus within an electronic control and/or warning system.

BACKGROUND

Roadway marking systems have long been used to provide vehicular equipment operators with pertinent information through the medium of roadway markers. As example, the white stripe painted on the roadway in front of a stop sign, familiar to the lay reader, provides a vehicle operator, the driver, with a physical limit or boundary that the driver's approaching vehicle should not exceed in coming to a full and complete stop in obedience to the stop sign. On multilane roadways, the lanes are delineated by roadway markers. And, at major airports service roads and corridors are often distinguished, in addition to signal lamps, by painted lines marking the borders to the service road, providing a visible guide for the pilot. The foregoing are but a few of the most common applications.

In more recent experience, roadway markers have also been adapted as part of vehicular guidance and control systems. The information provided by the roadway markers is used to automatically issue an alarm or steer and/or position a moving vehicle. Sensors on the vehicle detect a marked path along a roadway and the associated control equipment on the vehicle is able to automatically correct the vehicle's steering should the sensor detect the vehicle's departure from the marked path. From time to time newspapers report of experimental automobile control systems that are intended to automatically control and guide a vehicle's travel along a highway, eliminating the need for the driver's complete attention.

Examples of the foregoing appear in the patent literature. The system in U.S. Pat. No. 5,202,742 to Frank et al carries a laser radar carried on the vehicle to detect reflective markers along a roadway. The laser beam is scanned over the roadway and the associated detectors, which receive light reflected from the roadway markers, are used by associated control equipment on board the vehicle to guide the vehicle relative to the roadway markers. Another system is presented in U.S. Pat. No. 4,947,094 to Dyer et al. In the Dyer system a linear charge coupled device (CCD) carried by an industrial warehouse vehicle, such as a forklift, monitors the position of a track, such as formed by a painted line on the warehouse ceiling overlying the roadway. The CCD images that line and that imaging allows the control equipment in the system to steer the industrial vehicle along the track.

Though painted white stripes are often used, the better roadway markers are formed of a thermoplastic material, supplied by the manufacturer as minute plastic granules or beads, that is heated to place the material into the liquid form, which can flow. Often small spheroidal glass particles are mixed into the ingredients as part of the liquid. That hot liquid is coated or extruded in a thin strip onto the roadway surface, where the plastic material is allowed to cure, that is, solidify and harden. The plastic material is designed to seep into the rough surface and pores characteristic of pavement materials, such as cement and asphalt, and hardens to form a firm grip or bond to the pavement.

Such marker is relatively wear resistant, enduring the heavy pounding and friction of automobile tires. It resists the effects of snow and rain. It also resists to the deleterious effects of sunlight, including that from ultra-violet radiation. And it maintains its color for years, ensuring a visible contrast with the surface of the roadway. Although those who apply the marker to the roadway refer to the thermoplastic film simply as "paint", an analogy to house paint, a reference that carries forward in the subsequent description, roadway markers are understood as a serious field of endeavor.

It is noted that the exact composition of the various thermoplastic ingredient materials suitable for pavement marker application, not known to the present applicants, is well known to those skilled in the road marker art. As becomes apparent those details are not necessary to an understanding of the present invention and, hence, need not be further described. Those interested in learning more on that subject, may make reference to the technical literature in that field.

The foregoing marker and control systems make use of reflected light, that is, the visible region of the electromagnetic energy spectrum, and that light originates either naturally in the environment or is generated by a light source in the detection system. Other forms of energy, though not perceptible directly by human senses, are known and have also been applied in detection schemes. As one finds from the scientific literature, the electromagnetic energy spectrum extends over a wide range of wavelengths, extending at least from the shortest wavelengths, those in the ultra-violet region and below, to and beyond the longest wavelengths in the infra-red regions. One finds visible light in this spectrum, a region which human eyes are able to detect and which enables our vision, and also radio waves. The microwave spectrum lies in a portion of that radio spectrum; and in an end portion of that microwave spectrum, one finds the millimeter wave region.

Microwave and millimeter wave energy is emitted naturally from all objects. It is also incident on our Earth from outer space, and from the Earth's atmosphere, a gaseous object, irradiating, among other things, the roadways on which we travel. Since outer space is very cold, approximately four degrees Kelvin, and since the amount of energy emitted is proportional to the emitting objects physical temperature, very little energy is incident from outer space. For the most part the incident microwave/millimeter wave energy incident on the roadway is from the atmosphere itself, which serves or acts roughly speaking like a forty degree Kelvin emitter at a 94 GHz frequency. This energy, in part, is reflected from the materials on which it is incident, including the roadway and markers on the roadway. Those materials also emit a like kind of energy, and, since those materials are typically at "room temperature", 300 degrees Kelvin, they appear warmer, higher in temperature, than those materials that principally reflect the "cold sky".

In fact, according to Planck's radiation law, any perfectly absorbing body emits radiation at all frequencies of the energy spectrum. For most natural objects in our environment, such radiation is relatively high in the infra-red region of the energy spectrum, proportional to the fourth power of the object's physical temperature. At microwave/millimeter wave frequencies, the energy is much less, varying only directly with the temperature. Though less intense, that microwave/millimeter wave energy is detectable and measurable with properly designed microwave/millimeter wave radiometers.

Microwave/millimeter wave radiometric detectors are microwave/millimeter wave receivers that detect the total power received. A microwave/millimeter wave radiometer is, in effect, a highly sensitive total power receiver. The receiver receives its signals from a directional antenna, such as a microwave/millimeter wave horn antenna, whose receiving "footprint" or field of view is directed at the element or area to be observed. The magnitude of the signal received by the radiometer is proportional to the temperature of the object under observation, and/or the temperature reflected by the object, depending upon the percentage and types of objects within the antenna's footprint and the object's emissivity $\epsilon$, the latter being equal to $(1-\rho)$, where $\rho$ is the object's reflectivity. Radio astronomers have long used radiometric detectors to scan the heavens to detect planetary bodies and stars.

For convenience, the term, microwave/millimeter wave, is hereafter sometimes abbreviated to MMW. Thus, when used to modify the term radiometer, the abbreviated term distinguishes the radiometer discussed in connection with the present invention from other known types of radiometers, such as infra-red radiometers.

Radio astronomers also earlier determined the existence of "propagation windows" through the atmosphere for millimeter wave energy, frequencies in the 30 to 300 GHz range, at which the attenuation is relatively modest in both clear air and fog. That is, transmission of millimeter wave energy from outer space at those "window" frequencies are not attenuated in propagating through overlying clouds to their ground based radio telescopes as greatly as adjacent higher or lower frequencies in the millimeter wave region about that frequency. Similarly, the atmosphere does not emit as much energy in these windows, and, therefor does not "wash out" or overpower signals from space. These windows occur at 35 GHz, 94 GHz, 140 GHz and 220 GHz.

Imaging of ground objects, including aircraft runways, using MMW radiometric energy and MMW radiometric detectors, was proposed in the past. U.S. Pat. No. 3,725,930 to Caruso uses a microwave radiometer to detect a pattern of radiometric energy reflecting markers on an airport runway. Metal, such as iron, is known as a good MMW radiometric reflector; it is of high $\rho$. In Caruso's system, wedge shaped metal plates, of a size between two feet and twenty feet in diameter, are placed on the runway as markers to provide a surface tilted up from the runway surface as presents a ramp to the oncoming airplane. Microwave energy from a portion of the cold sky is thereby reflected toward radiometric detectors carried on the taxiing aircraft, and, thus, such markers stand out from the surrounding landscape as cold looking.

Although Caruso does not expressly describe the height of the metal ramps thus employed, one appreciates that any protrusion from the roadway surface poses an impediment to the taxiing airliner and other airport vehicles using the runway. At a minimum such obstacles would cause the aircraft to sustain a series of bumps, as might disturb the passengers, and, if great enough in height, would present an obstacle that would render Caruso's system impractical of application.

Placed on the runway, the large metal plate is visible to view and does not have the anonymity of a painted stripe. It can easily be removed from the roadway surface. The metal plate thus provides an attraction to those pranksters or unscrupulous persons who would detach and sell the metal as scrap, disabling a key element of the marker system. That visibility is an unfortunate practical drawback.

Further, in an article published by the assignee of the present invention "Passive Millimeter-Wave Imaging", Yujiri et al, *Quest Magazine*, TRW, Inc. 1990/1991, Vol. 13, No. 2, the authors, including one of the present inventors, present two dimensional pictures of the radiometric image of an airport, harbor and other scenes taken with experimental apparatus containing radiometric detectors tuned to receive energy at a frequency of 94 GHz. Though the images are of low resolution, the viability of radiometric inspection is demonstrated as technically feasible and urged as a soon-to-be practical means to achieve images of scenes, despite rain and fog weather conditions The article predicts additional technical development, and, though offering suggestions for radiometric imaging, the article offers no guidance on improving roadway marker systems.

Accordingly, an object of the present invention is to provide a new method for detecting roadway markers, one that uses MMW radiometers;

It is another object of the invention to provide a roadway marker detection and control system that is passive and does not require transmitting apparatus that emits electromagnetic energy;

It is a further object of the invention to provide a roadway marker paint having enhanced contrast with the adjoining roadway surface at MMW radiometric frequencies, a true "microwave/millimeter wave radiometric" paint; and It is a still further object of the invention to provide an enhanced radiometric paint that may be applied to roadway surfaces using existing unmodified paint striping equipment.

SUMMARY OF THE INVENTION

In accordance with the forgoing objects, an improved roadway marker detection method employs a vehicle or other wheeled platform capable of movement along the roadway surface. The vehicle supports a downwardly inclined looking radiometer a short distance above the roadway. The vehicle is then moved along the roadway and the MMW radiometric energy, reflected and/or emitted from the various patches of road surface and viewed as the vehicle progresses forward, is monitored and may be displayed. Any roadway markers encountered along the way are detected by a significant decrease in energy received by the radiometer as a result of viewing energy from the "cold" sky.

Unlike prior systems, the foregoing method distinguishes markers in rain or fog and in day or at night, with wet or snow covered roadways. Markers are detected passively. It is not necessary to emit electromagnetic radiation into the environment to make the detection, minimizing risks to personnel and avoiding possible interference to other electronics equipment. Moreover, since artificial illumination is unnecessary, the roadway infrastructure requirements are simplified.

In accordance with another aspect to the invention, a new roadway marker paint possesses enhanced MMW radiometric energy reflection characteristics obtained by incorporation of metal particles and/or high dielectric particles within the thermoplastic material of ordinary road marker paint. A preferred embodiment of the enhanced radiometric paint includes size 20 or 30 iron shot with the iron shot comprising approximately 30% of the paint mixture by volume.

When the foregoing inspection procedure is made of markers constructed in that way, the decrease in detected temperature is larger than before on some surfaces, such as asphalt, although the change is not as great on concrete. This evidences an increased radiometric contrast between the marker and the adjacent pavement. As a benefit the new radiometric paint may be applied to the roadway using existing paint striping equipment. With the increase in contrast between the radiometric energy reflecting characteristic of the marker and that of the roadway, a more pronounced measurement is available for detection. With increased signal, the signal to noise ratio is improved and detection is possible even if the sensitivity of the detector lowers with age.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
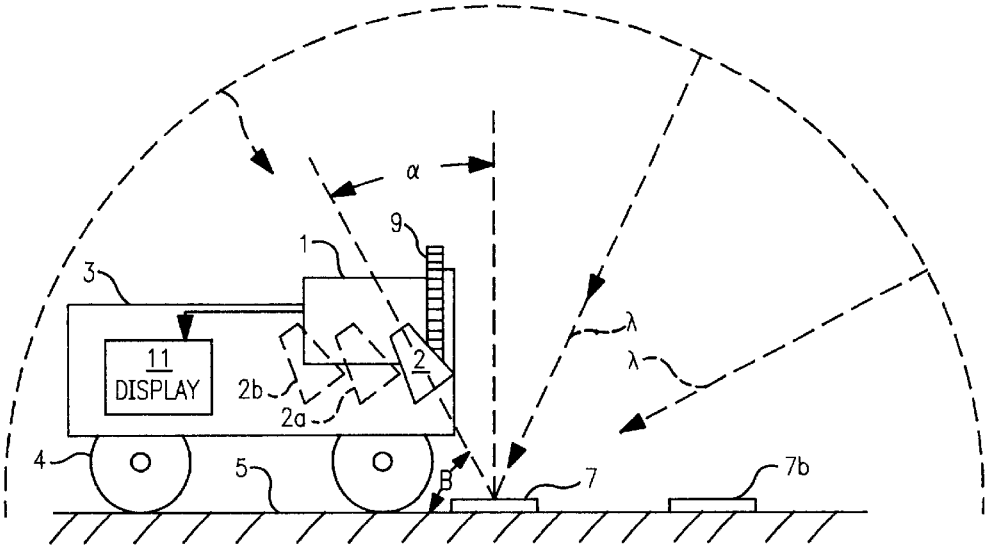
FIG. 1 pictorially illustrates the apparatus for carrying out the new method of detecting and interrogating roadway markers.

Reference is made to FIG. 1 which pictorially illustrates the new method for observing roadway markers. As illustrated in FIG. 1 a MMW radiometer assembly or radiometer, represented by block 1, is mounted at the front end of a wheeled cart 3 and at a predetermined height above the roadway 5. A marker 7 of predetermined width forms a stripe that extends at least partially across the roadway, in a direction perpendicular to the sheet of paper.

The MMW radiometer, which is of any known construction available in the marketplace, is suitably tuned to 94 GHz, is of a bandwidth of approximately 1 GHz or less and has attached a small aperture receiving antenna or horn 2 that is oriented downward at a steep angle to the road surface, suitably an angle, $\alpha$, from the vertical of about 20 degrees. The vertical position of the radiometer is adjustable by means of a track mounting 9 or equivalent, and, preferably, is positioned with the front end of feed horn 2 positioned approximately eight inches above the roadway.

It will be found that the MMW radiometric energy sensed at the MMW radiometer as reflected from a given material is subject to many variables including, but not limited to, the distance from the reflecting surface, the angle at which the antenna input is oriented relative to the surface, the polarization, horizontal or vertical, of the energy being sensed, and the frequency of that energy within the electromagnetic spectrum. The foregoing represents the present preference for those variables.

Figure 2:
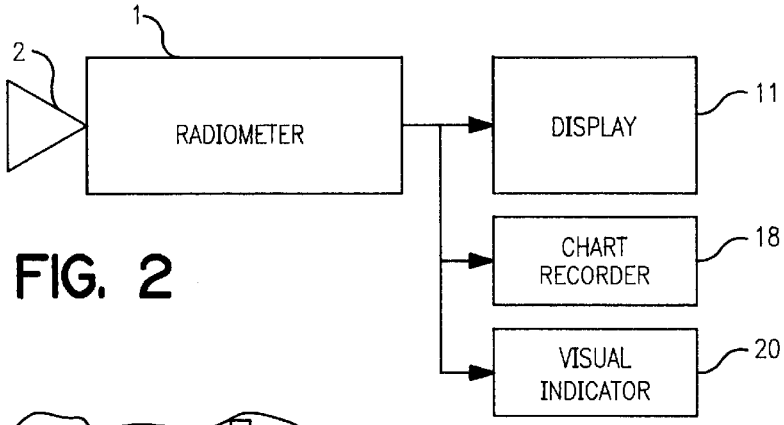
FIG. 2 is a block diagram of the electronic apparatus used in performing the method of FIG. 1.

FIG. 2 is a block diagram of the system electronics, showing the MMW radiometer 1 and its associated antenna 2 and the display 11, which may be a meter or a cathode ray tube monitor. The MMW radiometer outputs a voltage to the display. Other forms of output can be used independently or collectively as desired. A chart recorder 18 may be connected to receive the output and provide a continuous plot of values as the cart is moved along a predetermined path. A visual monitor circuit 20, can be calibrated to provide an output, such as lighting a lamp, that gives a visually perceptible indication when the temperature falls to a predetermined level, as when the MMW radiometer detects a marker.

MMW radiometer 2 is of any known type. It is an electrically powered radio receiving device and may be supplied with necessary electrical current to energize the MMW radiometer by a battery, not illustrated, carried on the cart or other conventional power supply. As example, a MMW radiometer marketed by the Millitech company of South Deerfield, Mass. is suitable for the procedure. Miniaturized MMW radiometers based on the microwave/millimeter wave monolithic integrated circuit technology, "MMIC" are available for 40 GHz operation through a distributor from the TRW company, assignee of the present application, and are expected to be available for 94 GHz operation in the near future. Miniaturized radiometers are preferred, particularly for the specific embodiments of the invention herein described. An output from the MMW radiometer is connected to an associated cathode ray tube display or digital or analog signal monitor 11 to permit the operator to view the radiometric temperature being sensed at the antenna 2.

In operation, with the MMW radiometer energized and operating, the cart is pushed or, if a self-propelled motorized structure moves forward, to the right in the figure, rolling forward on its wheels 4. As represented in the figure in dotted lines, 2*b* and 2*a* as the cart progresses forward the antenna moves horizontally. Looking down the antenna senses MMW radiometric energy, $\lambda$, emitted and reflected from the roadway surface.

As described in the background to this specification, microwave/millimeter wave energy referred to as MMW radiometric energy originating from the other planets, stars and atmosphere is incident on the earth, including roadway 5 and marker 7. This MMW radiometric energy arrives from all directions in the sky overhead, over essentially a hemisphere of overlying sky. The only exception is that portion of the sky that may be blocked or attenuated by the cart and the apparatus carried on that cart. The incident MMW radiometric energy penetrates the marker and the surface of the roadway. Since all materials reflect MMW radiometric energy, some materials to a greater extent than other materials, some of that MMW radiometric energy is reflected or "back scattered" into the receiver horn 2.

The product of emissivity of an object, $\epsilon$, and true physical temperature of the object equals its brightness temperature or, as otherwise termed, its radiometric temperature. A perfect absorber has an emissivity of 1.0 and is known as a black body and a perfect reflector has an emissivity of zero. The emissivity of an object, which is polarization dependent, is, for each polarization, vertical or horizontal, a function of the dielectric constant, the body's surface roughness, and the angle of observation. As measured at an angle of 90 degrees to the surface, that is, looking straight down, the emissivity of an object at frequency of 94 GHz such as bare metal is 0.040, dry gravel is 0.921, dry asphalt is 0.914, dry concrete is 0.905, dirt is 1.0.

The apparent temperature being radiated by an object is a combination of three sources and may be respresented by the following equation:

$$T=\epsilon Ta+\rho Ts+\tau Tb,$$

where, $\rho$ and $\tau$ are the emissivity, reflection and transmissivity coefficients, respectiviely; and Ta, Ts and Tb are the ambient termperature of the material, the reflected sky temperature and the temperature of the background behind the object, respectively. For metallic materials $\tau$Tb is negligible and may be ignored.

Antenna 2 receives MMW radiometric energy that is reflected in the foregoing way from the portion or patch of the surface that falls within the antenna's field of view. For a small aperture antenna, one of approximately one inch (2.54 cm.) in diameter, located eight inches (20 cm.) above the ground, the field of view is an area of approximately three square inches (7.6 square cm). Thus as the cart moves forward, the particular patch of surface viewed or sensed by the antenna and MMW radiometer apparatus continuously changes.

As so measured the roadway surface appears to be of a certain radiometric temperature. As the cart positions the antenna so that the antenna views a portion of the marker 7, the observed radiometric temperature decreases. With further movement in which the antenna's field of view is congruent with the marker 7, the MMW radiometric temperature observed is lower still. As the antenna moves further to the right beyond the position of marker 7, the temperature observed rises to the level initially observed, representing again the roadway surface. From the foregoing observations, thus, the downward transition in observed temperature level characterizes the presence of marker 7, and the steady lower temperature level indicates the presence of the marker still. The upward transition in temperature, characterizes the right side end of the marker.

Since the position of the antenna relative to the front of the cart is known, the antenna's height above the roadway surface is known, and the angle at which the antenna is inclined to the roadway surface, $\beta$, is known, a simple trigonometric calculation allows one to determine the exact position in front of the cart at which the marker is located. As is apparent to one skilled in the art, the sharpness of transition between the roadway and the marker depends in part on the size of the field of view of antenna 2; a smaller field of view provides a sharper transition and essentially increases the resolution of the observed surface. For this method, the smaller the field of view, the more accurately one can specify the front and back edges of the marker 7 as those edges are encountered during movement of cart 3.

Figure 3:
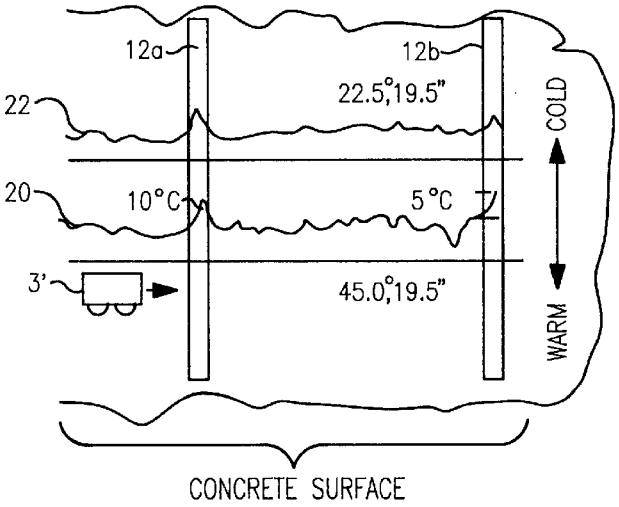
FIG. 3 is a chart illustrating radiometric measurements taken on a roadway using the apparatus of FIG. 1 in the novel method.

The chart of FIG. 3 shows the output of a MMW radiometer that was wheeled left to right across a parking lot roadway 5' containing stripe shaped road markers 12*a* and 12*b* formed by painting with paint and those stripes are overlaid upon a pictorial image of the parking lot roadway. Stripe 12*a* is of the composition of the enhanced MMW radiometric paint described in this specification and stripe 12*b* is formed of ordinary white roadway marker paint and such stripes are formed atop a portion of the roadway having a concrete surface. Similar results are obtained on an asphalt surface.

MMW radiometric measurements were taken with the air temperature at 15 degrees Centigrade and the measurements were made by a 94 GHz radiometer sensing the horizontally polarized radiation from the roadway at positions 12.5 inches above the roadway surface and 45 degree Nadir viewing angle, curve 20; and 19.5 inches above the roadway surface and 22.5 degree Nadir viewing angle, curve 22. In this figure, the ordinate is reversed in direction and represents decreasing values; hence, a lower temperature is represented as a higher vertical position. Considering curves 20 and 22, it is seen that the concrete produces a certain base temperature and that the measured temperature drops as the MMW radiometer passes over stripes 12*a* and 12*b*. As shown the decrease on stripe 12*a* is greater than that on stripe 12*b*.

The figure also shows the effect due to raising the height of the MMW radiometer. The temperature drops are not as pronounced as before. As later herein described, the preferred height for the MMW radiometer antenna input is 8 inches and the preferred viewing angle of 70 degrees, for the particular horn 2 that is used.

As is known, reflected MMW radiometric energy is polarized. It contains a component that is horizontally polarized and another component that is vertically polarized. Since the MMW radiometer apparatus is capable of selecting and measuring either polarization, one need only select one of the two components for measuring results. It is found that the energy received in the horizontally polarized component differs significantly from that reflected in the vertical component, but the relationship between measurements of like kind taken from different materials properly correlate. Thus in making a comparison between reflections from one material and another, one necessarily uses the same polarization in taking measurements. In the foregoing, the horizontal (or H) polarization was selected.

Figure 4:
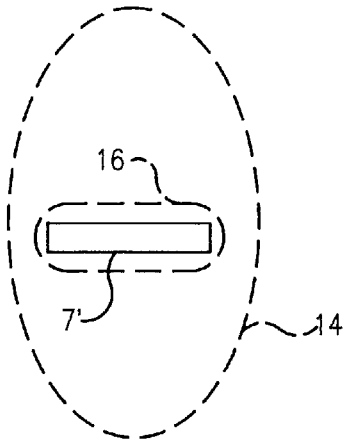
FIG. 4 illustrates the relationship between a roadway marker and different antenna fields of view.

It may be seen that the sensitivity of detection is in part dependent upon the antenna's field of view. As illustrated in FIG. 4, if the antenna's field of view is represented by the dash line 14, the area or patch of surface covered is significantly larger than the size of the metal marker 7' enclosed therewith. The latter marker thus has minimal influence on the radiometric temperature detected. However where the field of view is represented by dash line 16, a smaller patch than before, the area occupied by the marker represents a larger percentage of that area, at least thirty to fifty per cent of that area or more. Accordingly, the MMW radiometric temperature detected in the latter instance is determined in great part by the marker. Where possible, the size of the field of view should ideally be of the same size as the smallest size road marker. Thus the MMW radiometric temperature detected is dominated by that of the marker. And therefore the transition or change between the temperature of the roadway and the temperature of the marker is more pronounced as the detector is moved from the patch of roadway to the marker.

The MMW radiometric temperature reflected from a white painted stripe on the roadway or a more typical stripe of thermoplastic paint thereon is different from the temperature of the adjacent roadway, whether asphalt or concrete; and are also different from one another. Those differences are small, but measurable. However, because the differences are small, detection is difficult.

All electronic equipment, including MMW radiometers, receive electronic noise or generate electronic noise internally. Implicitly, noise interferes with the measurements. That noise may be of the same level of the signal of interest. As a result the signal often becomes "lost" in the noise. If possible, more sensitive and selective MMW radiometer apparatus should be employed. That equipment however is very expensive and impractical for use on ordinary vehicles. The better approach is to be given stronger signals to process, thereby increasing the signal-to-noise ratio. Thus, a marker that reflects incident MMW radiometric energy more strongly than does the thermoplastic paint marker is of obvious benefit in the disclosed roadway marker system. To that purpose the present invention encompasses an enhanced MMW radiometric paint, one that produces a stronger reflection and greater "MMW radiometric" contrast with the adjoining roadway.

The human eye is capable of distinguishing between different graduations between light and dark in black and white artwork found on a paper surface. The contrast between many different shades or graduations of gray is discernable with the naked eye. An analogous characteristic is found with respect to different materials and the relative intensity of MMW radiometric energy emitted and reflected by those materials, as observed by the MMW radiometer, during exposure to MMW radiometric energy. Some materials reflect greater intensity of incident MMW radiometric energy than other materials. This graduation or difference in reflectivity of one material compared to another material is referred to herein as "MMW radiometric contrast".

Paint is often defined as a mixture of a pigment and a suitable liquid to form an adherent coating when spread on a surface in a thin coat. The liquid may be viscous and serves as a binder or matrix which holds the pigment and through which the pigment is dispersed. Although the liquid itself may reflect some color, the color reflected by the pigment dominates. In this same sense, although the paint by itself reflects MMW radiometric energy, an enhanced MMW radiometric paint contains particulate matter of a material whose MMW radiometric reflecting characteristics are significantly better than those of the carrier liquid alone. An enhanced MMW radiometric paint improves the MMW radiometric contrast between the marker and the adjoining roadway surface, whether the roadway is concrete or asphalt or the like.

A first example of an enhanced MMW radiometric paint according to the invention is as follows: A mix is prepared of the pellets or beads of thermoplastic material, such as a vinyl, glass beads, and iron shot in the volume ratio of 50%, 25% and 25%, respectively. The ingredients are thoroughly mixed together to provide a homogenous mix. The glass beads are hollow ten mil diameter spheres. The iron shot is size number 20 to 30. The mixture is then placed in the mixing pot of a conventional road striping apparatus, such as the "highway striper" utilized by Sterndall Industries, and the pot is heated and raised in temperature to the requisite temperature normally used for liquefying thermoplastic. That liquification temperature, it is noted, is much lower than the temperature required to soften or liquify either the glass beads or iron shot. The thermoplastic material liquefies, while the glass beads and iron shot are unchanged. The MMW radiometric paint is now ready for application to the surface of the roadway, suitably formed of asphalt or concrete.

So liquified, the affixation equipment is moved to the position along the roadway at which the marker is to be applied. The operator then releases the liquid while moving the equipment, and the hot liquid material is dispensed, under control of the equipment operator, typically in a wide strip of pre-selected length and width. In California, longitudinal lines are typically 80 mils thick and transverse lines are 125 mils thick.

Suitably, the dispensing and movement of the application equipment is such as to deposit a one-eighth inch thick layer of the MMW radiometric paint. Preferably, a seven mil layer of minute 4 to 20 mil diameter glass beads are dusted on the still soft top surface of the marker to enhance the light reflecting properties of the marker, which is the conventional practice. As so painted on the roadway, the thermoplastic material is allowed to cure and forms a permanent wear resistant marker with the glass beads and iron shot encased in a thin thermoplastic binder.

In the foregoing application procedure, the striping machine operator performs the same procedures that are used with ordinary road markers. No special changes in application procedure are required due to the inclusion of the iron shot.

Figure 5:
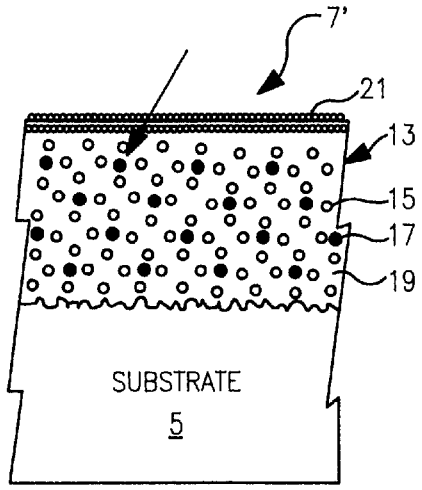
FIG. 5 illustrates an embodiment of the enhanced MMW radiometric paint of the invention in section view and applied to a roadway surface.

As applied to the roadway, the MMW radiometric paint according to the invention is illustrated in partial section view in FIG. 5. The paint 13 is bonded to the upper surface of the asphalt or concrete roadway 5 and is between 80 mils and ⅛th inch in thickness. The glass spheres 15 and the iron shot particles 17 are dispersed throughout the thermoplastic matrix 19. The upper surface of the paint contains a thin layer, about 7 mils thick, of minute glass beads, 21, as is the conventional practice in thermoplastic road markers. That forms marker 7' in place on the roadway.

Figure 6:
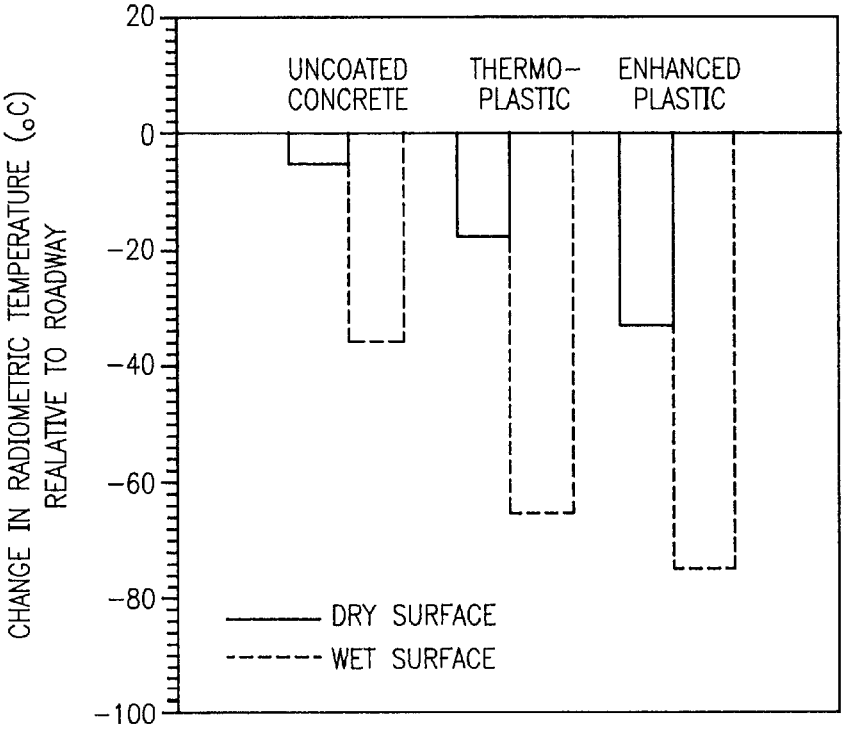
FIG. 6 is a bar chart showing the enhanced results obtained with the improved paint and a comparison with the other materials taken under like conditions.

FIG. 6 provides a bar chart of the radiometric temperature obtained on a cloudy day, from a viewing angle from Nadir of 33 degrees with the air temperature 17 degrees C using the 94 GHz MMW radiometer. As shown, the change in the radiometer temperature observed from the enhanced paint, relative to the surrounding concrete roadway, is substantially greater than from the marker formed principally of thermoplastic material; and that of the latter is significantly greater than that of the underlying concrete. The figure also shows what occurs when the roadway surface is wet. The temperature measured is signficantly lower than before. However, the incremental difference between the uncoated concrete and the enhanced marker, is still significant.

In an alternative embodiment, an alternative to the metal shot in the embodiment previously described, substitutes Titanium Oxide, a material having a high dielectric constant, at least 10, in comparison to the binder, which is about 2 to 3 in dielectric constant. This material, like the metal, may be formed into spheroidal shapes, pellets, cylinders and the like, and substituted for the metal. The higher dielectric material produces a higher MMW radiometric reflectivity.

To broadly characterize the enhanced MMW radiometric paint according to the invention, its MMW radiometric reflective characteristic should be given in terms of a fixed viewing angle and polarization and time of day. The MMW radiometric paint is one which, as applied to a dry flat surface as a coating or layer exhibits a radiometric temperature that is at least 24 degrees Centigrade below the uncoated concrete roadway, when the paint is viewed by a MMW radiometer tuned to 94 GHz and sensing only the horizontally polarized energy and the MMW radiometer's input antenna is oriented at twenty degrees from the normal, a twenty degree viewing angle, with such measurement taken at mid-afternoon on a clear day.

Painted-on roadway markers, enhanced with internal particles that reflect microwave/millimeter wave energy in the 30 to 300 GHz range, exposed to the sky, when observed by a MMW radiometric detector, appear colder in temperature than the adjacent asphalt or pavement forming the roadway, particularly when viewed by the MMW radiometric apparatus at steep angles, about 70 degrees. This contrast in temperature serves as indicium of the presence of the marker.

The paint appears colder as a result of the balance between what is emitted by the various materials and what they reflect. At steep observation angles, near vertical, the enhanced paint reflects more than it emits in comparison to the asphalt and/or concrete forming the roadway.

To minimize the possibility of adversely affecting the reliability of the marker, essentially the physical characteristics of the thermoplastic material, the amount of MMW radiometric particulate added to the thermoplastic material ideally should be held to a minimum necessary to achieve the desired result. So doing also maintains the cost of the mixture at a minimum, enhancing cost efficiency.

Based on experimentation, it may be shown that optimum "back-scattering" cross section achieves a maximum plateau of detectability at about the volume fraction of 0.1. That is, when the MMW radiometric particulate is ten percent of the mixture by volume. This optimum applies for any angle of incidence of the MMW radiometric detector of between ten degrees and eighty degrees from NADIR. In other words, if the percentage of MMW radiometric particulate is increased above ten per cent, say to twenty per cent, as example, the intensity of reflected MMW radiometric energy detected by the MMW radiometer is no better than before. As a result of the increased density of particles, the energy reflected by one particle may strike an overlying particle in the solid matrix, instead of radiating from the matrix to the detector.

Our investigation has determined that a layer thickness of one-eighth of an inch (0.125 inch) provides near optimum back-scattering with minimal layer thickness.

The foregoing optimum volume fraction is for a marker of 0.125 inches (0.32 cm) in thickness. For markers that are thinner, the optimum is achieved with a higher relative volume of MMW radiometric particulate. It is expected that the optimal volume percentages should be determined in further investigation of the parameters for application of the invention.

The marker forms a thin film or layer atop the road surface. Although raised slightly above the road surface, the layer's height is not significant in comparison to automobile and vehicle tire sizes. It bears a ratio on the order of 1 to 200 relative to a typical tire diameter. By that comparison the layer's thickness is minuscule. That is, the layer would not cause a thump or a perceptible bump for an automobile tire riding over the marker. Thus, as a practical matter the marker is regarded as being flush with the roadway surface, which is the meaning given herein to the term "flush".

The particulate material added to the mix is not intended to and does not significantly chemically react in the short term with the thermoplastic materials. They are relatively chemically inert relative to those substances. The particles are suspended in the hardened plastic, held captive in the solid matrix.

With the enhanced MMW radiometric paint, improved roadway marker systems using the novel method earlier described in this specification are made more practical. Thus as pictorially illustrated in FIG. 7, a set of MMW radiometer sensors 31 and 33 are mounted to the right and left sides of a freight truck 30. Each of the MMW radiometer sensors contains a set of four individual MMW radiometers, whose fields of view are individually illustrated as four elongate ellipses. Those elliptical fields of view are arranged essentially along side one another in a line perpendicular to the side of the vehicle. The MMW radiometer sensor 31 on the truck's right side as viewed by the driver monitors the relative position between the truck and the single roadway marker 35 on one side of a roadway lane. MMW Radiometer sensor 33 on the truck's left side monitors a set of two road markers 37 on the truck's left side.

Figure 8:
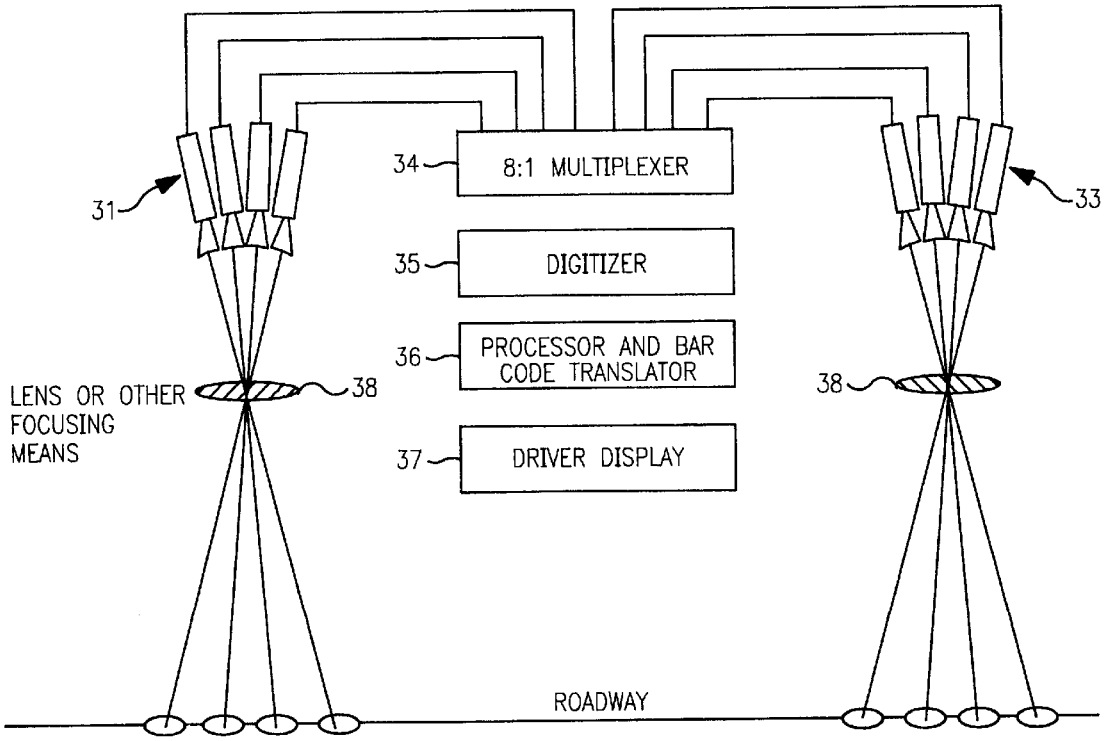
FIG. 8 is a block diagram of the electronic system for the truck of FIG. 7 for providing lane positioning information to the vehicle driver.

As represented in the block diagram of FIG. 8 the four radiometers forming sensor 31 and those forming sensor 33 are oriented toward the ground through a respective common focusing element, such as the respective one of the lenses 38 and 39. Each of the MMW radiometer systems detects MMW radiometric energy emitted and reflected from a marker encountered on the roadway. The output signals of each of the radiometers is received and processed by conventional electronic apparatus. The output signal from each MMW radiometer is sent via an eight to one multiplexer 34 and from that multiplexer to a signal digitizer 35. The digitized signal is stored sequentially in a programmed processor 36. The processor is programmed to monitor the position of the markers as detected by the radiometers, and to determine if the truck is centered in the traffic lane, or has drifted to the right or left. Should the truck have drifted to one side of the lane, the processor initiates an appropriate warning that is sent to the driver via a display 37.

Alternatively, in those systems that contain additional apparatus for automatic control of vehicle steering, an output signal from the processor can be fed to that apparatus to correct the vehicle steering. The foregoing electronic systems are of the type earlier suggested in prior radar type and photoelectric type control systems and need not be described in detail. Only the "front end" MMW radiometer apparatus as the sensor and the method for using that MMW radiometer is novel.

Figure 7:
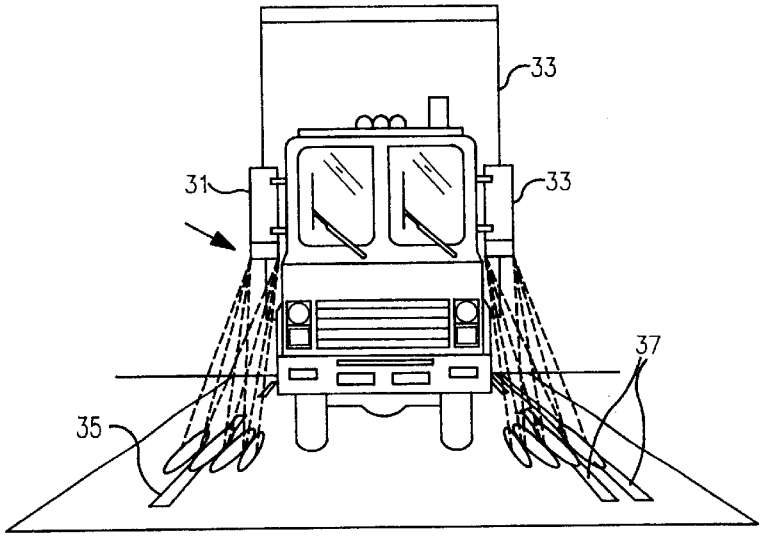
FIG. 7 pictorially illustrates a truck fitted with MMW radiometric detectors that use the novel roadway marker system to assist in positioning the truck within a roadway traffic lane.
Figure 9:
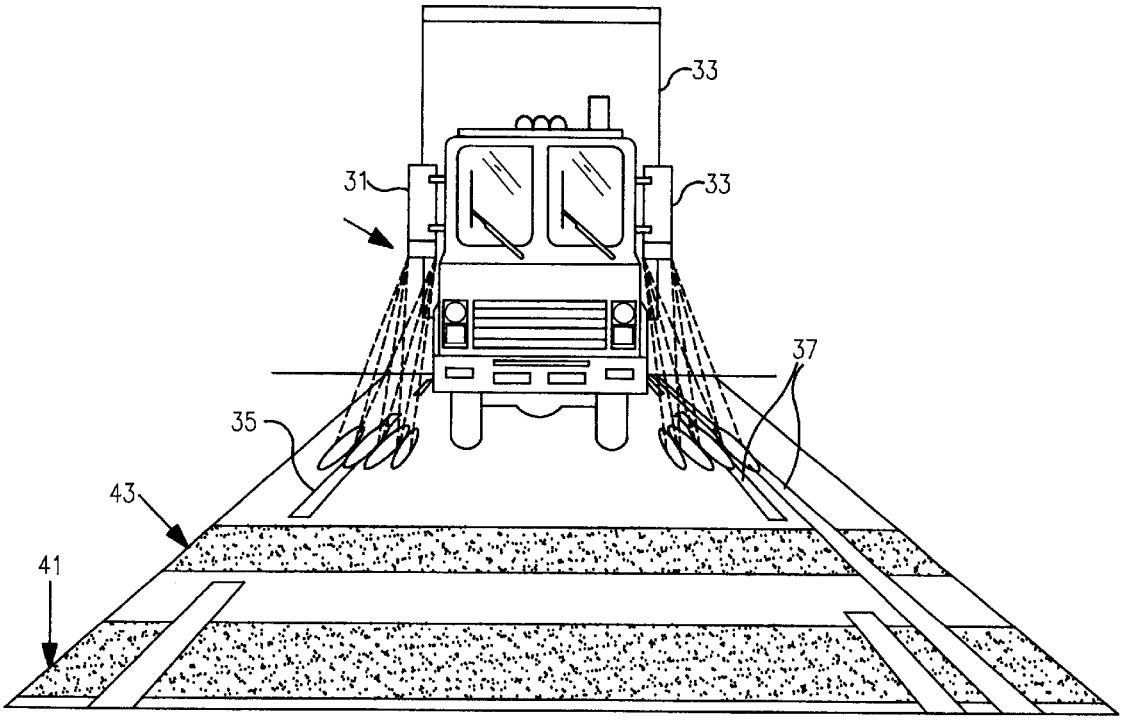
FIG. 9 pictorially illustrates a vehicle equipped with a passive MMW radiometric lane tracking system as in FIG. 7 and also equipped with a bar code information system using the same electronic system as in FIG. 8.

As pictorially illustrated in FIG. 9, where like elements to those which appeared in FIG. 7 are denominated by the same number, the roadway marker system may also incorporate sets of mMW radiometric markers, such as 41 and 43, that extend across the driving lane oriented perpendicular to the truck. The spacing and widths of the markers vary in prescribed ways and in that way carry information. The markers may be concealed, since they are not intended to provide any visible commands or suggest any boundary, such as would a white line across the roadway in front of a stop sign or a lane dividing line. Each set of lateral MMW radiometric markers together present a bar code, much like the UPC code found on boxes in the grocery store and the Postal bar code used on mailing envelopes. As those skilled in the bar code art are aware, the lines may be varied in width and the spacing between lines may be varied with the first one of the lines providing the synchronizing signal used by the decoding equipment.

As truck 30 moves across the information marker, a string of signals is detected nearly simultaneously by all the MMW radiometers, representing the bar code. Electronic translation apparatus carried on the truck connected to those MMW radiometers receives and decodes the signals and produces the translated information on a display that is visible to the driver.

The foregoing electronic apparatus of FIG. 9 is also represented in the block diagram of FIG. 8 to which reference is again made. The MMW radiometer 31 and 33 outputs are multiplexed, digitized, and processed by the programmed processor. Processor 36 includes a bar code translator, which translates the coded information represented by stripes 41 and 43 and generates a translated message that appears on display 37. Such bar code coding and bar code translating apparatus is well known and found in other systems, such as universal price code UPC bar codes and postal codes. The translator converts the received impulses into the English language message represented thereby through use of a stored translation dictionary. Thus the bar code that is detected may be translated as "curve ahead", relating cautionary information to the vehicle driver and that translated information is presented on message display 37.

A bar code pattern may thus be painted on the roadway to provide important information to the drivers of vehicles; as example, danger, the bridge ahead ices up in winter; railroad crossing ahead; curve ahead, trucks slow to 35 mph; gas and food turnoff. The possibilities are numerous.

MMW radiometers offer an advantage over radar devices. The MMW radiometer does not require a transmitter and, thereby, contains fewer parts to build, adjust and maintain. Unlike radar, the MMW radiometer does not irradiate the area under observation, or any persons located in the area. Only naturally occurring radiation is used. Thus public health issues and uncertainties regarding radiation sources and irradiation of persons is avoided. The MMW radiometric detection functions during the day, at night, in cloudy weather or foggy weather, and with roadways that are wet with rainwater.

MMW radiometric enhancement is inexpensive. Existing roadway marking affixation equipment can be used to apply the enhanced paint. No modifications are required for the equipment. The added ingredients, such as metal shot, are readily available and are inexpensive. Although the new paint is of particular benefit in the novel road marker detection system herein presented, as those skilled in the art appreciate, due to its enhanced "visibility" at MMW frequencies, the new paint would also be of likely benefit to the scene scanning radiometric systems, such as the picture taking system for providing a view of an airport runway, which is described in the Quest publication referred to in the background to this specification, and that described in the cited patent to Caruso.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. The method of detecting roadway markers on a roadway exposed to the sky, comprising the steps of:

positioning a MMW radiometric detector at a predetermined position above the roadway with the MMW radiometric detector's receiving antenna oriented at a predetermined angle to the roadway surface, said predetermined angle being 45 degrees or larger, but less than ninety degrees;

moving said MMW radiometric detector along and at a constant height above said roadway to traverse any roadway markers on said roadway; and monitoring the output of the detector for a change in output.

2. The method as defined in claim 1, wherein said predetermined angle is 70 degrees and wherein said MMW radiometric detector comprises tuning means for restricting electromagnetic energy detected to that electromagnetic energy having a frequency of approximately 94 GHz.

* * * * *